US010190471B2

(12) United States Patent
Döring

(10) Patent No.: US 10,190,471 B2
(45) Date of Patent: Jan. 29, 2019

(54) EXHAUST-GAS AFTER-TREATMENT DEVICE

(71) Applicant: MAN DIESEL & TURBO SE, Augsburg (DE)

(72) Inventor: Andreas Döring, München/Unterhaching (DE)

(73) Assignee: MAN Energy Solutions SE, Augsburg (DE)

( * ) Notice: Subject to any disclaimer, the term of this patent is extended or adjusted under 35 U.S.C. 154(b) by 0 days.

(21) Appl. No.: 15/310,404

(22) PCT Filed: Apr. 10, 2015

(86) PCT No.: PCT/EP2015/000761
§ 371 (c)(1),
(2) Date: Nov. 10, 2016

(87) PCT Pub. No.: WO2015/180809
PCT Pub. Date: Dec. 3, 2015

(65) Prior Publication Data

US 2017/0268402 A1 Sep. 21, 2017

(30) Foreign Application Priority Data

May 24, 2014 (DE) ..... 10 2014 007 858

(51) Int. Cl.
*F01N 13/00* (2010.01)
*F01N 3/24* (2006.01)
(Continued)

(52) U.S. Cl.
CPC ..... *F01N 13/017* (2014.06); *F01N 1/003* (2013.01); *F01N 1/089* (2013.01); *F01N 3/24* (2013.01);
(Continued)

(58) Field of Classification Search
CPC . F01N 1/003; F01N 1/089; F01N 3/24; F01N 13/017; F01N 2230/00; F01N 2230/04; F01N 2490/10; F01N 2590/02
See application file for complete search history.

(56) References Cited

U.S. PATENT DOCUMENTS

2005/0022515 A1* 2/2005 Stiermann ..... B01D 53/9431 60/286
2006/0185348 A1 8/2006 Mayer et al.
(Continued)

FOREIGN PATENT DOCUMENTS

CN 1311998 4/2007
CN 103547775 1/2014
(Continued)

OTHER PUBLICATIONS

Office Action dated Aug. 17, 2017 which issued in the corresponding Korean Patent Application No. 10-2016-7027032.
(Continued)

*Primary Examiner* — Audrey K Bradley
(74) *Attorney, Agent, or Firm* — Cozen O'Connor

(57) ABSTRACT

Disclosed is an exhaust-gas after-treatment device for an internal combustion engine, in particular for a ship's diesel internal combustion engine that is operated with heavy oil, including: a housing through which exhaust gas flows; exhaust-gas purification chambers formed in the housing, which chambers hold catalysts and/or particulate filters in order to purify the exhaust gas; and muffler chambers formed in the housing, which chambers have a defined depth for muffling sound in the flow direction. The exhaust-gas purification chambers and the muffler chambers are arranged spatially in series and parallel to one another on the flow side.

13 Claims, 1 Drawing Sheet

(51) Int. Cl.

| | |
|---|---|
| ***F01N 1/04*** | (2006.01) |
| ***F01N 1/24*** | (2006.01) |
| ***F01N 1/08*** | (2006.01) |
| ***F01N 1/00*** | (2006.01) |
| *F01N 3/035* | (2006.01) |

(52) U.S. Cl.
CPC ..... *F01N 13/0097* (2014.06); *F01N 3/035* (2013.01); *F01N 2230/00* (2013.01); *F01N 2230/04* (2013.01); *F01N 2330/02* (2013.01); *F01N 2330/04* (2013.01); *F01N 2490/10* (2013.01); *F01N 2590/02* (2013.01)

(56) References Cited

U.S. PATENT DOCUMENTS

| | | | | |
|---|---|---|---|---|
| 2012/0144809 | A1* | 6/2012 | Ducroquet ..... | F01N 3/2066 60/295 |
| 2012/0216515 | A1* | 8/2012 | Norton ..... | F01N 13/04 60/299 |

FOREIGN PATENT DOCUMENTS

| | | | | |
|---|---|---|---|---|
| DE | 24 17 435 | | 10/1975 | |
| DE | 101 23 359 | | 11/2002 | |
| DE | 103 16 799 | | 10/2004 | |
| DE | 10 2010 009946 | | 9/2011 | |
| DE | 10 2011 015512 | | 10/2012 | |
| EP | 1 262 643 | | 12/2002 | |
| EP | 1262643 | A1 * | 12/2002 | ..... B01D 53/9431 |
| EP | 1 503 055 | | 2/2005 | |
| JP | 2006-348884 | | 12/2006 | |
| JP | 2012-202245 | | 10/2012 | |
| JP | 2013-221463 | | 10/2013 | |
| JP | 2014-508885 | | 4/2014 | |

OTHER PUBLICATIONS

Office Action dated Jul. 9, 2018 which issued in the corresponding Japanese Patent Application No. 2016-553317.
Office Action dated Jun. 1, 2018 which issued in the corresponding Chinese Patent Application No. 201580027190.9.

* cited by examiner

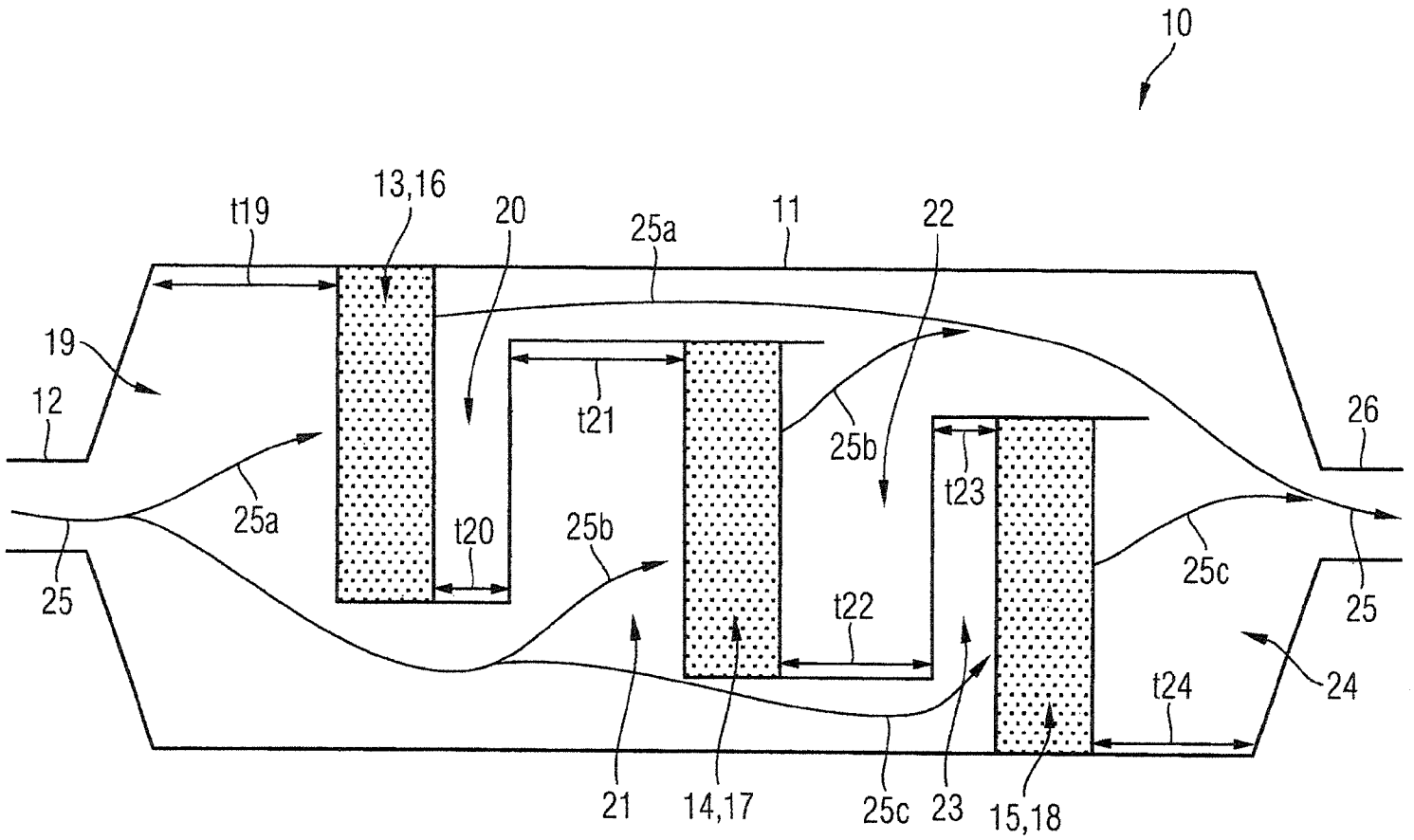
10
26
25
24
25c
t24
15,18
t23
23
22
25b
t22
25c
11
14,17
25a
t21
25b
21
20
t20
13,16
t19
25a
19
12
25

EXHAUST-GAS AFTER-TREATMENT DEVICE

CROSS REFERENCE TO RELATED APPLICATIONS

This is a U.S. national stage of application no. PCT/EP2015/000761, filed on Apr. 10, 2015. Priority is claimed on German Application No.: DE102014007858.2, filed May 24, 2014, the content of which is incorporated herein by reference.

BACKGROUND OF THE INVENTION

1. Field of the Invention

The invention relates to an exhaust gas after-treatment device.

2. Description of the Prior Art

From practice it is known that both catalytic converters and mufflers can be arranged as exhaust gas after-treatment assemblies downstream of an internal combustion engine. The catalytic converters serve in particular for the denitrification and/or desulphurisation of the exhaust gas and thus for the reduction of nitrogen oxide emissions and sulphur oxide emissions. The mufflers serve for the noise reduction and thus the decrease of sound emissions. In the case of internal combustion engines known from practice, the catalytic converters and mufflers are always embodied as separate assemblies, as a result of which a major space requirement materialises.

SUMMARY OF THE INVENTION

An object of one aspect of the present invention is creating a new type of exhaust gas after-treatment device.

The exhaust gas after-treatment device according to one aspect of the invention comprises a housing through which exhaust gas flows, wherein in the housing exhaust gas purification chambers are formed, which for the exhaust gas purification accommodate catalytic converters and/or particulate filters; wherein in the housing muffler chambers are formed, which for have a defined depth for muffling sound in flow direction, and wherein the exhaust gas purification chambers and the muffler chambers are arranged spatially in series and parallel to one another on the flow side.

With the invention it is proposed to integrate on the one hand exhaust gas purification components such as catalytic converters and/or particulate filters and on the other hand mufflers in an exhaust gas after-treatment device, as a result of which the requirement of installation space compared with the prior art can be reduced.

According to an advantageous further development, at least some muffler chambers have different depths. In particular when some muffler chambers have different depths, different frequencies can be attenuated in the muffler chambers, so that broad-band noise attenuation is then possible.

According to an advantageous further development, the exhaust gas purification chambers and the muffler chambers are arranged parallel to one another on the flow side in such a manner that an exhaust gas flow that flows through the housing can be divided into a number N of exhaust gas part flows, which in each case flow through an exhaust gas purification chamber that is individual for each of the exhaust gas part flows and preferentially through at least one muffler chamber that is individual for each of the exhaust gas part flows. The exhaust gas part flows, having flowed through the exhaust gas purification chambers and muffler chambers, can be united to form the exhaust gas flow. In this way, particularly effective exhaust gas purification in the catalytic converters and/or particulate filters on the one hand and particularly effective noise reduction in the muffler chambers is possible on the other hand with low installation space requirement.

Preferentially, the exhaust gas purification chambers and the muffler chambers are arranged parallel to one another on the flow side in such a manner that the each individual exhaust gas purification chamber and muffler chamber of an i-th exhaust gas part flow is connected in terms of flow parallel to the or each individual exhaust gas purification chamber and muffler chamber (i+1)-th exhaust gas part flow, wherein i=1 to (n−1). Because of this, effective exhaust gas purification and effective muffling with simultaneous reduction of the installation space requirement is possible.

Preferentially, the exhaust gas purification chambers and the muffler chambers are spatially arranged in series with respect to one another in such a manner that each individual exhaust gas purification chamber and muffler chamber of an i-th exhaust gas part flow is arranged spatially in front of the or each individual exhaust gas purification chamber and muffler chamber of an (i+1)-th exhaust gas part flow, wherein i=1 to (N−1). This also makes possible effective exhaust gas purification and effective muffling with simultaneous reduction of the installation space requirement.

BRIEF DESCRIPTION OF THE DRAWINGS

Exemplary embodiments of the invention are explained in more detail by way of the drawing without being restricted to this.

The FIGURE is a schematic representation of an exhaust gas after-treatment device.

DETAILED DESCRIPTION OF THE PRESENTLY PREFERRED EMBODIMENTS

The invention relates to an exhaust gas after-treatment device for an internal combustion engine, in particular for a marine diesel engine operated with heavy fuel oil.

The FIGURE shows an exemplary embodiment of an exhaust gas after-treatment device 10 according to the invention, wherein the exhaust gas after-treatment device 10 comprises a housing 11 through which exhaust gas flows.

The housing 11 comprises an inlet 12 and an outlet 26 for the exhaust gas 25 flowing through the housing 11 of the exhaust gas after-treatment device 10.

In the housing 10, exhaust gas purification chambers 13, 14, 15 are formed, for exhaust gas purification of the exhaust gas 25 flowing through the housing 11 of the exhaust gas after-treatment device 10 that accommodate catalytic converters 16, 17, 18 and/or particulate filters. Furthermore, muffler chambers 19, 20, 21, 22, 23, 24 are formed in the housing 11 of the exhaust gas after-treatment device 10 for muffling that have defined depths t19, t20, t21, t22, t23, t24.

The exhaust gas purification chambers 13, 14, 15 and muffler chambers 19, 20, 21, 22, 23, 24 are jointly integrated in the common housing 11 of the exhaust gas after-treatment device 10 or formed in the common housing 11 are on the one hand arranged serially with respect to space and on the other hand parallel to one another with respect to flow.

The exhaust gas purification chambers 13, 14, 15 and the muffler chambers 19 to 24 in this case are arranged parallel to one another on the flow side in such a manner that an exhaust gas flow 25, which enters the housing 11 of the exhaust gas after-treatment device 10, is divisible into a number N of exhaust gas part flows 25*a*, 25*b* and 25*c*, which according to the FIGURE in each case flow through at least one exhaust gas purification chamber 13, 14 and 15 respectively that is individual for each of the exhaust gas part flows 25*a*, 25*b* and 25*c*. Accordingly, the exhaust gas part flow 25*a* flows through the exhaust gas purification chamber 13, the exhaust gas part flow 25*b* through the exhaust gas purification chamber 14 and the exhaust gas part flow 25*c* through the exhaust gas purification chamber 15.

Furthermore, each of the exhaust gas part flows 25*a*, 25*b* and 25*c* preferentially flows through at least one muffler chamber that is individual for the respective exhaust gas part flow 25*a*, 25*b* and 25*c*, wherein the exhaust gas part flow 25*a* flows through the individual muffler chamber 20, the exhaust gas part flow 25*b* through the individual muffler chamber 22, the exhaust gas part flow 25*c* through the individual muffler chamber 23.

Accordingly, all exhaust gas purification chambers 13, 14 and 15 for the exhaust gas part flows 25*a*, 25*b* and 25*c* as exhaust gas purification chambers 13, 14, 15 that are individual for the respective exhaust gas part flows 25*a*, 25*b* and 25*c* are always flowed through exclusively by one of the exhaust gas part flows 25*a*, 25*b* and 25*c*.

Some of the muffler chambers 19 to 24, namely the muffler chambers 20, 22 and 23 are likewise designed as muffler chambers that are individual for the exhaust gas part flows 25*a*, 25*b* and 25*c*, so that the muffler chambers 20, 22 and 23 are always flowed through exclusively by one of the exhaust gas part flows 25*a*, 25*b* and 25*c*. Other muffler chambers 19, 21, 24 by contrast are formed as common muffler chambers, which are jointly flowed through by a multiple of the exhaust gas part flows 25*a*, 25*b* and 25*c*. Accordingly, the muffler chamber 19 is flowed through by the entire exhaust gas flow 25 and accordingly by all three exhaust gas part flows 25*a*, 25*b* and 25*c*. The muffler chamber 21 is flowed through by both the exhaust gas part flows 25*b* and 25*c*. The muffler chamber 24 in turn is flowed through by the entire exhaust gas flow 25.

In the shown exemplary embodiment, N=3, the exhaust gas flow 25 is accordingly divided into three exhaust gas part flows 25*a*, 25*b* and 25*c*. However it is obvious that the exhaust gas flow 25 can also be divided into merely two or into more than three exhaust gas flows.

With a quantity N of exhaust gas part flows, into which the exhaust gas 25 of the exhaust gas after-treatment device 10 can be divided, the exhaust gas purification chambers 13 to 15 and the muffler chambers 19 to 24 are arranged parallel to one another on the flow side in such a manner that the or each individual exhaust gas purification chamber 13, 14, 15 and/or the or each individual muffler chamber 20, 22, 23 of each i-th exhaust gas flow (i=1 to N−1) are connected parallel to the or each individual exhaust gas purification chamber in terms of flow and individual muffler chamber of an (i+1)-th exhaust gas part flow.

The exhaust gas purification chambers 13 to 15 and the muffler chambers 19 to 24 are additionally arranged with regard to space in series relative to one another in such a manner that the or each individual exhaust gas purification chamber 13, 14, 15 and the or each individual muffler chamber 20, 22, 23 of each i-th exhaust gas part flow is arranged spatially in front of the or each individual exhaust gas purification chamber and individual muffler chamber of an (i+1)-th exhaust gas part flow.

From the FIGURE it is evident that all exhaust gas purification chambers 13 to 15 as well as all muffler chambers 19 to 24 are arranged seen in flow direction of the housing 10 spatially in series one behind the other.

In the above manner, multiple catalytic converters 16 to 18 and/or particulate filters can be integrated in the multiple exhaust gas purification chambers 13 to 15, wherein multiple muffler chambers 19 to 24 are likewise integrated in one and the same housing 11. Because of this, both an effective exhaust gas purification in the exhaust gas purification chambers 13 to 15 and also an effective muffling in the muffler chambers 19 to 24 can be ensured in one and the same exhaust gas after-treatment device 10, namely with minimal installation space requirement of the exhaust gas after-treatment device 10 according to the invention.

Particularly preferred is a version of the exhaust gas after-treatment device 10 according to the invention, in which at least some of the muffler chambers 19 to 24 have different depths t19 to t24 seen in flow direction of the same. In this way, different frequencies of the exhaust gas noise can then be attenuated in the individual muffler chambers 19 to 24, which have different depths, so that broad-band attenuation of the exhaust gas noises is possible.

The different depths t19 to t24 are advantageously embodied in such a manner that they correspond to a quarter of the wavelength ($\lambda/4$) to be attenuated. By forming different depths, different wavelengths can thus be attenuated, as a result of which broad-band attenuation becomes possible. For forming the $\lambda/4$ muffler effect, the side walls and the end face of the exhaust gas after-treatment element are arranged in parallel, so that a standing wave can form.

In a version of the invention, all muffler chambers 19 to 24 each have different depths t19 to t24.

To further optimise the muffling, walls of the muffler chambers 19 to 24 and/or walls of the housing 11 and/or walls of the exhaust gas purification chambers 13 to 15, which are not flowed through, can be provided with a sound absorption material.

The exhaust gas purification assemblies that are integrated in the exhaust gas purification chambers 13, 14 and 15 can be SCR catalytic converters, NOx storage catalytic converters, $CH_4$ oxidation catalytic converters, CO oxidation catalytic converters, HCHO oxidation catalytic converters and/or particulate filters.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. An exhaust gas after-treatment device for an internal combustion engine, comprising:

a housing through which exhaust gas from the internal combustion engine flows;

exhaust gas purification chambers having substantially parallel walls arranged in the housing and configured to accommodate at least one of catalytic converters and particulate filters; and muffler chambers having substantially parallel walls arranged in the housing, each having a defined depth in a flow direction and configured to muffle, wherein each gas purification chamber is bounded by a respective muffler chamber at each gas purification chamber's input and output in the flow direction;

wherein the exhaust gas purification chambers and the muffler chambers are arranged in series spatially, and wherein the exhaust gas purification chambers and the muffler chambers are arranged parallel to one another with respect to flow, wherein respective end faces of each muffler chamber and each gas purification chamber are arranged in parallel, so that a standing wave can form.

2. The exhaust gas after-treatment device according to claim 1, wherein at least two of the muffler chambers have different depths.

3. The exhaust gas after-treatment device according to claim 1, wherein each muffler chamber has a different depth.

4. The exhaust gas after-treatment device according to claim 1, wherein all exhaust gas purification chambers and all muffler chambers are one of jointly formed in the housing and integrated in the housing.

5. The exhaust gas after-treatment device according to claim 1, further comprising a sound absorption material arranged on one or more walls of the muffler chambers and the housing, which are not flowed through.

6. The exhaust gas after-treatment device according to claim 1, wherein the exhaust gas purification chambers and the muffler chambers are arranged parallel to one another with respect to flow such that an exhaust gas flow, which flows through the housing, is divisible into a number N of partial exhaust gas flows, wherein each of the N partial exhaust gas flows flows through a respective exhaust gas purification chamber and a respective muffler chamber, wherein the partial exhaust gas flows having flowed through the exhaust gas purification chambers and muffler chambers are reunited to form the exhaust gas flow.

7. The exhaust gas after-treatment device according to claim 6, wherein each exhaust gas purification chamber is formed as an exhaust gas purification chamber that is dedicated for a respective partial exhaust flow such that each exhaust gas purification chamber is always flowed through exclusively by one of the partial exhaust gas flows.

8. The exhaust gas after-treatment device according to claim 6, wherein the exhaust gas purification chambers and the muffler chambers are arranged parallel to one another with respect to flow such that one or each individual exhaust gas purification chamber and muffler chamber of an i-th partial exhaust gas flow is connected in terms of flow parallel to the one or each individual exhaust gas purification chamber and muffler chamber of an (i+1)-th partial exhaust gas flow, wherein i=1 to (N−1).

9. The exhaust gas after-treatment device according to claim 6, wherein the exhaust gas purification chambers and the muffler chambers are arranged serially with respect to one another in terms of space such that one or each individual exhaust purification chamber and muffler chamber of an i-th partial exhaust gas flow is arranged spatially in front of the one or each individual exhaust gas purification chamber and muffler chamber of an (i+1)-th partial exhaust gas flow, wherein i=1 to (N−1).

10. The exhaust gas after-treatment device according to claim 6, wherein one or more of the muffler chambers are formed as muffler chambers that are individual for the partial exhaust gas flows such that a respective muffler chamber is always flowed through exclusively by one of the partial exhaust gas flows.

11. The exhaust gas after-treatment device according to claim 10, wherein one or more of the muffler chambers are formed as common muffler chambers for the partial exhaust gas flows such that a respective muffler chamber is jointly flowed through by a plurality of the partial exhaust gas flows.

12. A marine diesel engine operated with heavy fuel oil comprising:

an exhaust gas after-treatment device for the marine diesel engine, comprising:

a housing through which exhaust gas from the marine diesel engine flows;

exhaust gas purification chambers arranged in the housing and configured to accommodate at least one of catalytic converters and particulate filters; and muffler chambers having substantially parallel walls arranged in the housing, each having a defined depth in a flow direction and configured to muffle, wherein each gas purification chamber is bounded by a respective muffler chamber at each gas purification chamber's input and output in the flow direction;

wherein the exhaust gas purification chambers and the muffler chambers are arranged in series spatially, and wherein the exhaust gas purification chambers and the muffler chambers are arranged parallel to one another with respect to flow, wherein respective end faces of each muffler chamber and each gas purification chamber are arranged in parallel, so that a standing wave can form.

13. An exhaust gas after-treatment device for an internal combustion engine, comprising:

a housing through which exhaust gas from the internal combustion engine flows;

exhaust gas purification chambers having substantially parallel walls arranged in the housing and configured to accommodate at least one of catalytic converters and particulate filters, each exhaust gas purification chamber having an input and output; and muffler chambers having substantially parallel walls arranged in the housing, each having a defined depth in a flow direction and configured to muffle, wherein each gas purification chamber is bounded by a respective muffler chamber at each gas purification chamber's input and output in the flow direction;

wherein the exhaust gas purification chambers and the muffler chambers are arranged in series spatially, and wherein the exhaust gas purification chambers and the muffler chambers are arranged parallel to one another with respect to flow, wherein the defined depth of each of the muffler chambers corresponds to a quarter of a wavelength to be attenuated.

* * * * *